US008570249B2

(12) United States Patent
Han

(10) Patent No.: US 8,570,249 B2
(45) Date of Patent: Oct. 29, 2013

(54) PIXEL COUPLED TO THREE HORIZONTAL LINES AND ORGANIC LIGHT EMITTING DISPLAY DEVICE USING THE SAME

(75) Inventor: Sam-Il Han, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 606 days.

(21) Appl. No.: 12/828,036

(22) Filed: Jun. 30, 2010

(65) Prior Publication Data

US 2011/0090213 A1 Apr. 21, 2011

(30) Foreign Application Priority Data

Oct. 15, 2009 (KR) ..... 10-2009-0098182

(51) Int. Cl.
*G09G 3/30* (2006.01)

(52) U.S. Cl.
USPC ..... 345/76; 345/213

(58) Field of Classification Search
USPC ..... 345/76, 77, 213
See application file for complete search history.

(56) References Cited

U.S. PATENT DOCUMENTS 7,978,156 B2 * 7/2011 Kim ..... 345/76
2006/0097966 A1 * 5/2006 Choi ..... 345/77
2007/0035487 A1 * 2/2007 Ryu et al. ..... 345/76
2008/0036704 A1 * 2/2008 Kim et al. ..... 345/76
2009/0121981 A1 * 5/2009 Yoo et al. ..... 345/76

FOREIGN PATENT DOCUMENTS

KR 10-2005-0106834 11/2005
KR 10-2006-0023672 3/2006
KR 10-2008-0050113 6/2008
KR 10-0846591 B1 7/2008

OTHER PUBLICATIONS

Korean Patent Abstracts, Publication No. 1020080050113, dated Jun. 5, 2008, corresponding to Korean Patent 10-0846591.

* cited by examiner

*Primary Examiner* — Kwang-Su Yang
(74) *Attorney, Agent, or Firm* — Christie, Parker & Hale, LLP

(57) ABSTRACT

A pixel and organic light emitting display device. The pixel includes an organic light emitting diode, first through fourth transistors, and a second capacitor. The fourth transistor is for controlling an amount of current flowing through the organic light emitting diode. A first transistor is coupled between a second terminal of the second capacitor and a data line and is configured to turn on in response to a scan signal supplied to an i-th scan line. A second transistor is coupled between a first terminal of the second capacitor and an initial power source and is configured to turn on in response to an other scan signal supplied to an (i−1)-th scan line. A third transistor is coupled between the second terminal of the second capacitor and a reference power source and is configured to turn off in response to an emission control signal supplied to an (i+1)-th emission control line.

11 Claims, 4 Drawing Sheets

PIXEL COUPLED TO THREE HORIZONTAL LINES AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2009-0098182, filed on Oct. 15, 2009, in the Korean Intellectual Property Office, the entire content of which is incorporated herein by reference.

BACKGROUND

1. Field

Aspects of the present invention relate to a pixel and an organic light emitting display device using the same.

2. Description of Related Art

In recent years, various flat panel display devices having reduced weight and volume in comparison to cathode ray tubes have been developed. Examples of such flat panel display devices include a liquid crystal display device, a field emission display device, a plasma display panel, an organic light emitting display device, etc.

Among the flat panel display devices, the organic light emitting device displays an image by using organic light emitting diodes that emit light by recombining holes with electrons. The organic light emitting display device has advantages such as low power consumption and rapid response speed.

SUMMARY

Accordingly, embodiments of the present invention provide a pixel and an organic light emitting display device using the same that can display an image having desired luminance.

According to an exemplary embodiment of the present invention, a pixel is provided. The pixel includes an organic light emitting diode, first through fourth transistors, and a second capacitor. The organic light emitting diode has a cathode electrode coupled to a second power source. The fourth transistor is for controlling an amount of current flowing to the second power source from a first power source via the organic light emitting diode. The second capacitor has a first terminal coupled to a gate electrode of the fourth transistor. The first transistor is coupled between a second terminal of the second capacitor and a data line and is configured to turn on in response to a scan signal supplied to an i-th scan line. The second transistor is coupled between the first terminal of the second capacitor and an initial power source and is configured to turn on in response to an other scan signal supplied to an (i−1)-th scan line. The third transistor is coupled between the second terminal of the second capacitor and a reference power source and is configured to turn off in response to an emission control signal supplied to an (i+1)-th emission control line.

The initial power source may have a voltage at which the fourth transistor is turned on.

The initial power source may have a voltage lower than that of the first power source.

The amount of current may be controlled by a voltage difference between a voltage of the data signal supplied to the data line and a voltage of the reference power source.

The pixel may further include a first capacitor and fifth and sixth transistors. The first capacitor is coupled between the first terminal of the second capacitor and the first power source. The fifth transistor is for diode-connecting the fourth transistor when the scan signal is supplied to the i-th scan line. The sixth transistor is coupled between the fourth transistor and the organic light emitting diode and is configured to turn off in response to an other emission control signal supplied to an i-th emission control line.

According to another exemplary embodiment of the present invention, an organic light emitting display device is provided. The organic light emitting display device includes a scan driver, a data driver, and pixels. The scan driver is for sequentially supplying scan signals to scan lines and sequentially supplying emission control signals to emission control lines. The data driver is for supplying data signals to data lines in synchronization with the scan signals. The pixels are located at crossing regions of the data lines, the scan lines, and the emission control lines. Each of the pixels located on an i-th horizontal line includes an organic light emitting diode, first through fourth transistors, and a second capacitor. The organic light emitting diode has a cathode electrode coupled to a second power source. The fourth transistor is for controlling an amount of current to the second power source from a first power source via the organic light emitting diode. The second capacitor has a first terminal coupled to a gate electrode of the fourth transistor. The first transistor is coupled between a second terminal of the second capacitor and one of the data lines and is configured to turn on in response to one of the scan signals supplied to an i-th scan line of the scan lines. The second transistor is coupled between the first terminal of the second capacitor and an initial power source and is configured to turn on in response to an other of the scan signals supplied to an (i−1)-th scan line of the scan lines. The third transistor is coupled between the second terminal of the second capacitor and a reference power source and is configured to turn off in response to one of the emission control signals supplied to an (i+1)-th emission control line of the emission control lines.

The initial power source may have a voltage at which the fourth transistor is turned on.

The initial power source hay have a voltage lower than that of the first power source.

The amount of current may be controlled by a voltage difference between a voltage of one of the data signals supplied to the one of the data lines and a voltage of the reference power source.

Each of the pixels may further include a first capacitor and fifth and sixth transistors. The first capacitor is coupled between the first terminal of the second capacitor and the first power source. The fifth transistor is for diode-connecting the fourth transistor when the one of the scan signals is supplied to the i-th scan line. The sixth transistor is coupled between the fourth transistor and the organic light emitting diode and is configured to turn off in response to an other of the emission control signals supplied to an i-th emission control line of the emission control lines.

The scan driver may supply an other of the emission control signals to an i-th emission control line of the emission control lines concurrently with the scan signals supplied to the (i−1)-th scan line and the i-th scan line.

As described above, according to embodiments of the present invention of a pixel and an organic light emitting display device using the same, it is possible to control the amount of current flowing to an organic light emitting diode irrespective of first power and threshold voltage of a driving transistor, thereby displaying an image having a desired luminance.

BRIEF DESCRIPTION OF THE DRAWINGS

The accompanying drawings, together with the specification illustrate exemplary embodiments of the present invention, and, together with the description, serve to explain the principles of the present invention.

FIG. 4 is a waveform diagram showing a driving method of a pixel shown in

FIG. 3.

DETAILED DESCRIPTION

Figure 1:
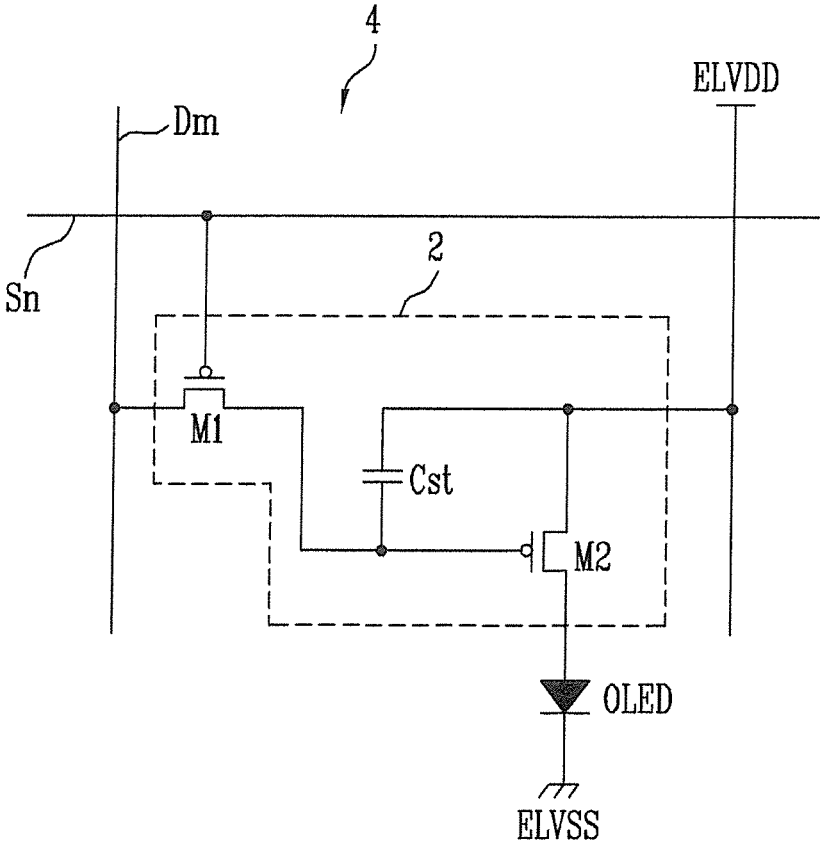
FIG. 1 (Prior Art)
FIG. 1 is a circuit diagram showing a conventional pixel.

Hereinafter, certain exemplary embodiments of the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

FIG. 1 is a circuit diagram showing a pixel of a conventional organic light emitting display device.

Referring to FIG. 1, the pixel 4 of the conventional organic light emitting display device includes an organic light emitting diode (OLED) and a pixel circuit 2 for controlling the OLED, coupled to a data line Dm and a scan line Sn. An anode electrode of the OLED is coupled to the pixel circuit 2 and a cathode electrode of the OLED is coupled to a second power ELVSS. The OLED generates light having predetermined luminance in accordance with the amount of current supplied from the pixel circuit 2.

The pixel circuit 2 controls the amount of current supplied to the OLED in accordance with a data signal supplied from the data line Dm when a scan signal is supplied to the scan line Sn. For this, the pixel circuit 2 includes a second transistor M2 coupled between a first power ELVDD and the OLED, a first transistor M1 coupled between the second transistor M2, the data line Dm, and the scan line Sn, and a storage capacitor Cst coupled between a gate electrode and a first electrode of the second transistor M2.

A gate electrode of the first transistor M1 is coupled to the scan line Sn and the first electrode of the first transistor M1 is coupled to the data line Dm. In addition, a second electrode of the first transistor M1 is coupled to one terminal of the storage capacitor Cst.

Here, the first electrode is set as either a source electrode or a drain electrode and the second electrode is set as the other one of the source electrode or the drain electrode. For example, when the first electrode is the source electrode, the second electrode is the drain electrode. The first transistor M1 coupled to the scan line Sn and the data line Dm is turned on when the scan signal is supplied from the scan line Sn, such that the data signal supplied from the data line Dm is supplied to the storage capacitor Cst. At this time, the storage capacitor Cst is charged with voltage corresponding to the data signal.

A gate electrode of the second transistor M2 (e.g., the driving transistor) is coupled to one terminal of the storage capacitor Cst and the first electrode of the second transistor M2 is coupled to the other terminal of the storage capacitor Cst and the first power ELVDD. In addition, a second electrode of the second transistor M2 is coupled to the anode electrode of the OLED.

The second transistor M2 controls the amount of current that flows to the second power ELVSS via the OLED from the first power ELVDD in accordance with a voltage stored in the storage capacitor Cst. In addition, the OLED generates light corresponding to the amount of current supplied from the second transistor M2.

However, in the conventional organic light emitting display device, a voltage of the first power ELVDD varies depending on the position of the pixel. More specifically, a voltage drop in the first power ELVDD takes place across the display unit, the magnitude of which varies depending on the position of each pixel 4, such that an image having desired luminance may not be displayed. Further, in the conventional organic light emitting display device, threshold voltages of the driving transistors included in the pixels 4 varies, such that such that an image having desired luminance may not be displayed.

Exemplary embodiments of the present invention will be described in detail with reference to FIGS. 2 to 6 so that those skilled in the art can practice embodiments of the present invention.

Figure 2:
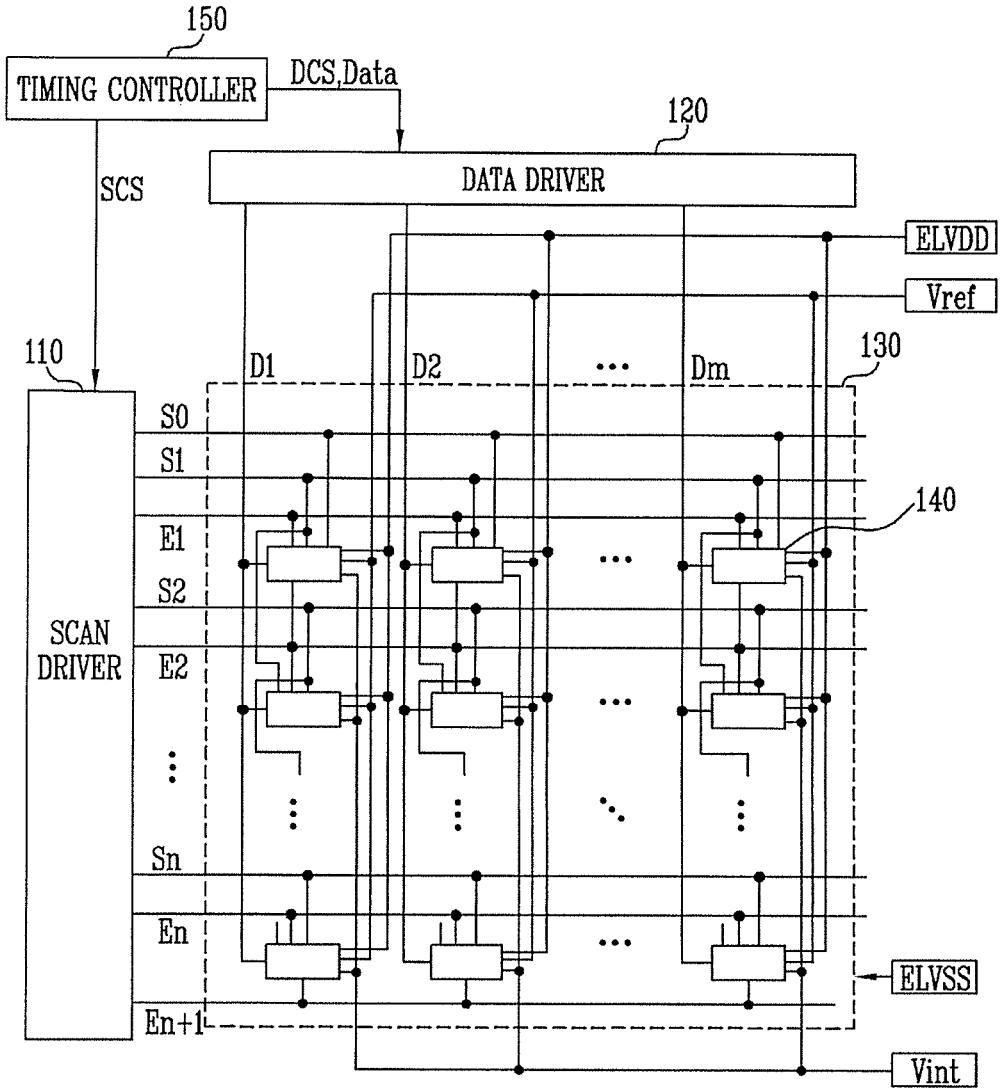
FIG. 2 is a diagram showing an organic light emitting display device according to an embodiment of the present invention.

FIG. 2 is a diagram showing an organic light emitting display device according to an embodiment of the present invention.

Referring to FIG. 2, the organic light emitting display device includes a display unit 130 including a plurality of pixels 140 that are coupled to scan lines S0 to Sn, emission control lines E1 to En+1, and data lines D1 to Dm. The organic light emitting display device also includes a scan driver 110 for driving the scan lines S0 to Sn and the emission control lines E1 to En+1, a data driver 120 for driving the data lines D1 to Dm, and a timing controller 150 for controlling the scan driver 110 and the data driver 120.

The timing controller 150 generates a data driving control signal DCS and a scan driving control signal SCS in accordance with synchronization signals supplied from the outside. The data driving control signal DCS generated by the timing controller 150 is supplied to the data driver 120 and the scan driving control signal SCS is supplied to the scan driver 110. In addition, the timing controller 150 rearranges and supplies Data provided from the outside to the data driver 120.

The scan driver 110 receives the scan driving control signal SCS and sequentially supplies scan signals to the scan lines S0 to Sn and sequentially supplies emission control signals to the emission control lines E1 to En+1. Here, an emission control signal supplied to an i-th emission control line Ei overlaps with a scan signal supplied to an (i−1)-th scan line Si−1 and an i-th scan line Si. In addition, the scan signal has a voltage (e.g., low voltage) at which transistors included in the pixels 140 can be turned on and the emission control signal is set to a voltage (e.g., high voltage) at which the transistors included in the pixels 140 can be turned off.

The data driver 120 receives the data driving control signal DCS from the timing controller 150 and supplies the data signals to the data lines D1 to Dm in synchronization with the scan signal supplied to the scan lines S0 to Sn.

The display unit 130 includes the pixels 140 formed in areas (e.g., crossing regions) defined by the scan lines S0 to Sn, the emission control lines E1 to En+1, and the data lines D1 to Dm. The pixels 140 receive a first power ELVDD, a second power ELVSS, a reference power Vref, and an initial power Vint from the outside. The pixels 140 receiving the reference voltage Vref and the initial voltage Vint generate light having luminance corresponding to voltage differences between the reference power Vref and the data signals. For this, a pixel 140 positioned on an i-th horizontal line is coupled to the (i−1)-th scan line Si−1, the i-th scan line Si, an i-th emission control line Ei, and an (i+1)-th emission control line Ei+1.

Figure 3:
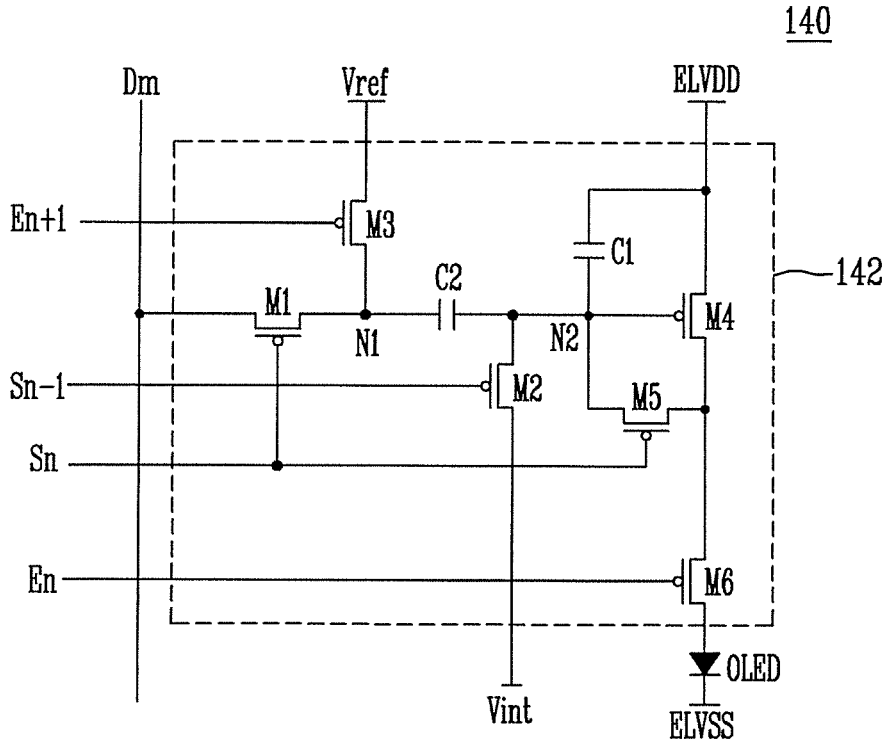
FIG. 3 is a circuit diagram showing an embodiment of a pixel shown in FIG. 2.

FIG. 3 is a circuit diagram showing an embodiment of a pixel shown in FIG. 2. In FIG. 3, a pixel coupled to an m-th data line Dm, an (n−1)-th scan line Sn−1, and an n-th scan line Sn is shown for the convenience of description.

Referring to FIG. 3, the pixel 140 includes an organic light emitting diode (OLED) and a pixel circuit 142 for supplying current to the OLED. An anode electrode of the OLED is coupled to the pixel circuit 142 and a cathode electrode of the OLED is coupled to the second power ELVSS. The OLED generates light having a desired luminance (e.g., a predetermined luminance) corresponding to the amount of current supplied from the pixel circuit 142.

The pixel circuit 142 controls the amount of current that flows to the second power ELVSS from the first power ELVDD via the OLED in accordance with the voltage difference between the data signal supplied from the data line Dm and the reference power Vref. For this, the pixel circuit 142 includes first to sixth transistors M1 to M6, a first capacitor C1, and a second capacitor C2.

A first electrode of the first transistor M1 is coupled to the data line Dm and a second electrode of the first transistor M1 is coupled to a first node N1. In addition, a gate electrode of the first transistor M1 is coupled to the n-th scan line Sn. The first transistor M1 is turned on when the scan signal is supplied to the n-th scan line Sn to electrically couple the first node N1 with the data line Dm.

A first electrode of the second transistor M2 is coupled to a second node N2 and a second electrode of the second transistor M2 is coupled to the initial power Vint. In addition, a gate electrode of the second transistor M2 is coupled to the (n−1)-th scan line Sn−1. The second transistor M2 is turned on when the scan signal is supplied to the (n−1)-th scan line Sn−1 to electrically couple the second node N2 with the initial power Vint.

A first electrode of the third transistor M3 is coupled to the reference power Vref and a second electrode of the third transistor M3 is coupled to the first node N1. In addition, a gate electrode of the third transistor M3 is coupled to the (n+1)-th emission control line En+1.The third transistor M3 is turned on when the emission control signal is not supplied to the (n+1)-th emission control line En+1 to electrically couple the reference power Vref with the first node N1.

The fourth transistor M4 is for controlling an amount of current flowing to the second power ELVSS from the first power ELVDD via OLED. A first electrode of the fourth transistor M4 (e.g., the driving transistor) is coupled to the first power ELVDD and a second electrode of the fourth transistor M4 is coupled to a first electrode of the sixth transistor M6. In addition, the gate electrode of the fourth transistor M4 is coupled to the second node N2. The fourth transistor M4 supplies current corresponding to a voltage applied to the second node N2 to the first electrode of the sixth transistor M6.

A first electrode of the fifth transistor M5 is coupled to a second electrode of the fourth transistor M4 and a second electrode of the fifth transistor M5 is coupled to the second node N2. In addition, a gate electrode of the fifth transistor M5 is coupled to the n-th scan line Sn. The fifth transistor M5 is turned on when the scan signal is supplied to the n-th scan line Sn to diode-connect fourth transistor M4.

The first electrode of the sixth transistor M6 is coupled to the second electrode of the fourth transistor M4 and a second electrode of the sixth transistor M6 is coupled to the anode electrode of the OLED. In addition, a gate electrode of the sixth transistor M6 is coupled to the n-th emission control line En. The sixth transistor M6 is turned on when the emission control signal is not supplied to the n-th emission control line En to electrically couple the anode electrode of the OLED with the second electrode of the fourth transistor M4.

A first terminal of the second capacitor C2 is coupled to the first electrode of the second transistor M2 and the gate electrode of the fourth transistor M4. A second terminal of the second capacitor C2 is coupled to the second electrode of the first transistor M1 and the second electrode of the third transistor M3.

A first terminal of the first capacitor C1 is coupled to the first terminal of the second capacitor C2. A second terminal of the first capacitor C1 is coupled to the first power ELVDD.

Figure 4:
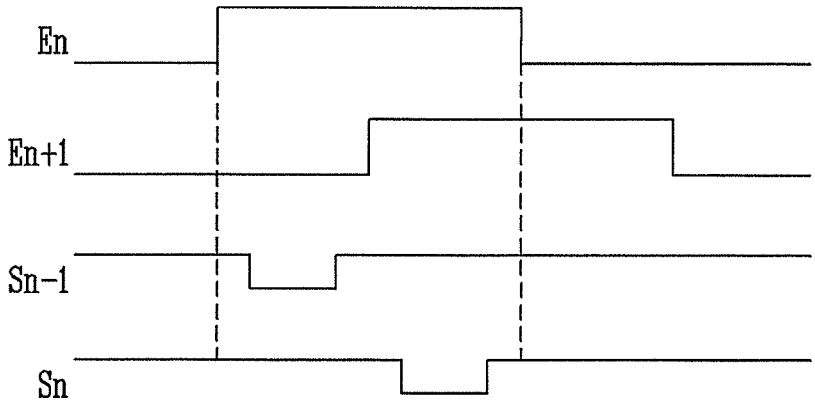

FIG. 4 is a waveform diagram showing a driving method of a pixel shown in FIG. 3.

An operation of the pixel 140 is described referring to FIGS. 3 and 4. First, the emission control signal is supplied to the n-th emission control line En and the scan signals are sequentially supplied to the (n−1)-th scan line Sn−1 and the n-th scan line Sn concurrently with the emission control signal supplied to the n-th emission control line En. When the emission control signal is supplied to the n-th emission control line En, the sixth transistor M6 is turned off and when the scan signal is supplied to the (n−1)-th scan line Sn−1, the second transistor M2 is turned on.

When the sixth transistor M6 is turned off, the electrical connection between the OWED and the fourth transistor M4 is interrupted. When the second transistor M2 is turned on, the initial power Vint is supplied to the second node N2. Here, the voltage of the initial power Vint is set to a voltage at which the fourth transistor M4 can be turned on, for example, a voltage lower than that of the first power ELVDD.

After the initial power Vint is supplied to the second node N2, the scan signal is supplied to the n-th scan line Sn and the emission control signal is supplied to the (n+1)-th emission control line En+1. When the scan signal is supplied to the n-th scan line Sn, the first transistor M1 and the fifth transistor M5 are turned on. When the emission control signal is supplied to the (n+1)-th emission control line En+1, the third transistor M3 is turned off.

When the third transistor M3 is turned off, the electrical connection between the first node N1 and the reference power Vref is interrupted. When the first transistor M1 is turned on, the data line Dm and the first node N1 are electrically coupled to each other, such that the data signal is supplied to the first node N1.

When the fifth transistor M5 is turned on, the fourth transistor M4 is diode-connected. Thus, since the voltage of the second node N2 is set to the initial power Vint, the fourth transistor M4 is turned on. When the fourth transistor M4 is turned on, the voltage of the first power ELVDD is supplied to the second node N2 via the fourth transistor M4 that is diode-connected. At this time, a voltage corresponding to subtracting an absolute threshold voltage of the fourth transistor M4 from the first power ELVDD is supplied to the second node N2, such that the first capacitor C1 is charged with voltage corresponding to the threshold voltage of the fourth transistor M4.

Thereafter, supplying the emission control signal to the n-th emission control line En is stopped. When not supplying the emission control signal to the n-th control line En, the sixth transistor M6 is turned on to electrically couple the OLED with the fourth transistor M4. After supplying the emission control signal to the n-th emission control line En is stopped, supplying the emission control signal to the (n+1)-th emission control line En+1 is stopped. When supplying the emission control signal to the (n+1)-th emission control line En+1 is stopped, the voltage of the reference power Vref is supplied to the first node N1.

When the reference power Vref is supplied to the first node N1, the voltage of the first node N1 is changed from the voltage of the data signal to the voltage of the reference power Vref. Here, the voltage of the reference power Vref is experimentally determined in consideration of capacities of the first capacitor C1, the second capacitor C2, and the voltage of the data signal. In one embodiment of the present invention, a gray level is implemented by using a voltage difference between the data signal and the reference power Vref. Therefore, the voltage of the reference power Vref is determined to display an image having desired luminance in consideration of factors such as the resolution and size of a panel, the capacities of the first capacitor C1 and the second capacitor C2, etc. One of ordinary skill in the art would know how to determine the reference power Vref.

When the voltage of the first node N1 is changed from the voltage of the data signal to the voltage of the reference power Vref, the voltage of the second node N2 is changed as shown in Equation 1.

$$V_{N2}=ELVDD-|Vth(M4)|+C2/(C1+C2)\times(Vref-Vdata) \qquad \text{Equation 1}$$

In Equation 1, Vth(M4) represents the threshold voltage of the fourth transistor M4 and Vdata represents the voltage of the data signal.

Referring to Equation 1, when the voltage of the first node N1 is changed, the voltage of the second node N2 is changed in accordance with the capacities of the first capacitor C1 and the second capacitor C2 and the difference voltage between the reference power Vref and the data signal Vdata. Here, because the capacities of the first capacitor C1 and the second capacitor C2 are fixed values (e.g., predetermined fixed values), the voltage of the second node N2 is determined by the reference power Vref and the voltage Vdata of the data signal.

When the voltage of the second node N2 is set as shown in Equation 1, gate-source voltage of the fourth transistor M4 is set to a value removing the first power ELVDD from Equation 1. In this case, the current that flows to the OLED is set regardless of the first power ELVDD. That is, it is possible to display an image having desired luminance regardless of the voltage drop of the first power ELVDD.

Figure 5:
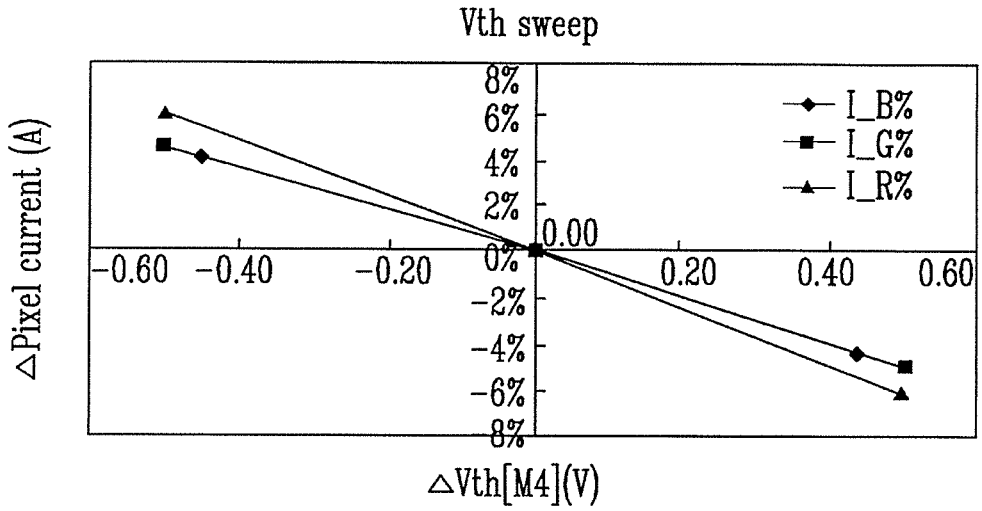
FIG. 5 is a simulation result showing current variation corresponding to variation of threshold voltage of the fourth transistor shown in FIG. 3.

FIG. 5 is a simulation result showing current variation corresponding to variation of threshold voltage of the fourth transistor M4 shown in FIG. 3.

Referring to FIG. 5, as the threshold voltage of the fourth transistor M4 is changed by within ±0.5V, current variation of the pixels 140 is limited within ±6%. That is, it is possible to display the image having the desired luminance by compensating for the threshold voltage of the fourth transistor M4.

Figure 6:
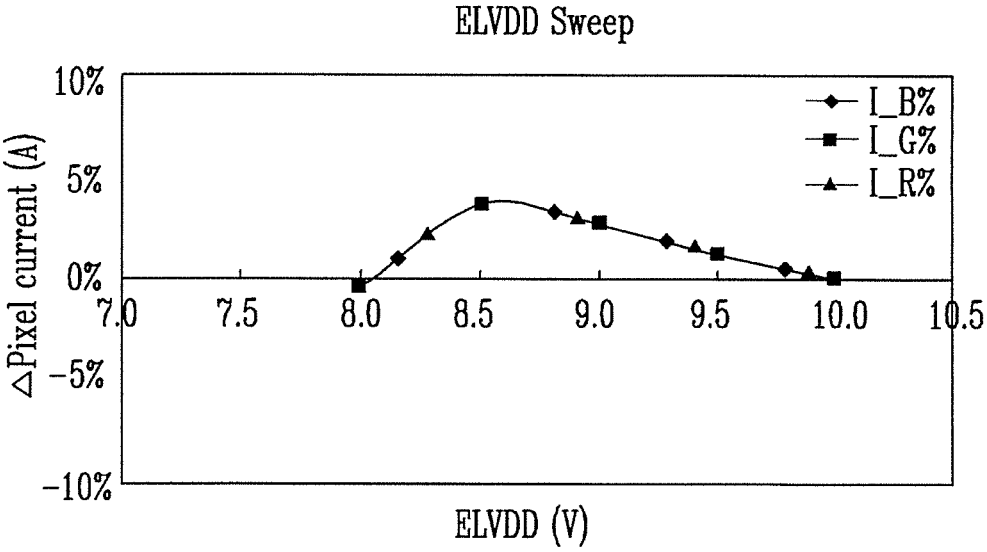
FIG. 6 is a simulation result showing current variation corresponding to voltage variation of the first power in the pixel show in FIG. 3.

FIG. 6 is a simulation result showing current variation corresponding to voltage variation of the first power in the pixel shown in FIG. 3.

Referring to FIG. 6, when the voltage of the first power ELVDD is changed from 10V to 8V, current variation of the pixels 140 is limited within 5%. That is, even though a voltage drop of the first power ELVDD is generated, it is possible to display an image having a desired luminance (e.g., a predetermined target luminance).

While aspects of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel located on an i-th horizontal line of a plurality of horizontal lines, where i is a positive integer and each of the horizontal lines includes a scan line and an emission control line, the pixel being coupled to the scan line of an (i−1)-th horizontal line of the horizontal lines, the scan line of the i-th horizontal line, the emission control line of the i-th horizontal line, and the emission control line of an (i+1)-th horizontal line of the horizontal lines, the pixel comprising:

an organic light emitting diode having a cathode electrode coupled to a second power source, an emission of the organic light emitting diode being controlled by an emission control signal supplied to the emission control line of the i-th horizontal line;

a fourth transistor for controlling an amount of current flowing to the second power source from a first power source via the organic light emitting diode;

a first capacitor having a first terminal coupled to a gate electrode of the fourth transistor;

a first transistor coupled between a second terminal of the first capacitor and a data line, and configured to turn on in response to a scan signal supplied to the scan line of the i-th horizontal line;

a second transistor coupled between the first terminal of the first capacitor and an initial power source, and configured to turn on in response to a scan signal supplied to the scan line of the (i−1)-th horizontal line; and a third transistor coupled between the second terminal of the first capacitor and a reference power source, and configured to turn off in response to an emission control signal supplied to the emission control line of the (i+1)-th horizontal line.

2. The pixel of claim 1, wherein the initial power source has a voltage at which the fourth transistor is turned on.

3. The pixel of claim 2, wherein the initial power source has a voltage lower than that of the first power source.

4. The pixel of claim 1, wherein the amount of current is controlled by a voltage difference between a voltage of a data signal supplied to the data line and a voltage of the reference power source.

5. The pixel of claim 1, further comprising:

a second capacitor coupled between the first terminal of the first capacitor and the first power source;

a fifth transistor for diode-connecting the fourth transistor when the scan signal is supplied to the scan line of the i-th horizontal line; and a sixth transistor coupled between the fourth transistor and the organic light emitting diode, and configured to turn off in response to the emission control signal supplied to the emission control line of the i-th horizontal line.

6. An organic light emitting display device comprising:

a scan driver for sequentially supplying scan signals to scan lines and sequentially supplying emission control signals to emission control lines;

a data driver for supplying data signals to data lines in synchronization with the scan signals; and pixels located at crossing regions of the data lines, the scan lines, and the emission control lines, wherein each of the pixels is located on an i-th horizontal line of a plurality of horizontal lines, where i is a positive integer and each of the horizontal lines includes one of the scan lines and one of the emission control lines, coupled to the one of the scan lines of an (i−1)-th horizontal line of the horizontal lines, the one of the scan lines of the i-th horizontal line, the one of the emission control lines of the i-th horizontal line, and the one of the emission control lines of an (i+1)-th horizontal line of the horizontal lines, and comprises:

an organic light emitting diode having a cathode electrode coupled to a second power source, an emission of the organic light emitting diode being controlled by one of the emission control signals supplied to the one of the emission control lines of the i-th horizontal line;

a fourth transistor for controlling an amount of current to the second power source from a first power source via the organic light emitting diode;

a first capacitor having a first terminal coupled to a gate electrode of the fourth transistor;

a first transistor coupled between a second terminal of the first capacitor and one of the data lines, and configured to turn on in response to one of the scan signals supplied to the one of the scan lines of the i-th horizontal line;

a second transistor coupled between the first terminal of the first capacitor and an initial power source, and configured to turn on in response to one of the scan signals supplied to the one of the scan lines of the (i−1)-th horizontal line; and a third transistor coupled between the second terminal of the first capacitor and a reference power source, and configured to turn off in response to one of the emission control signals supplied to the one of the emission control lines of the (i+1)-th horizontal line.

7. The organic light emitting display device of claim 6, wherein the initial power source has a voltage at which the fourth transistor is turned on.

8. The organic light emitting display device of claim 7, wherein the initial power source has a voltage lower than that of the first power source.

9. The organic light emitting display device of claim 6, wherein the amount of current is controlled by a voltage difference between a voltage of one of the data signals supplied to the one of the data lines and a voltage of the reference power source.

10. The organic light emitting display device of claim 6, each of the pixels located on the i-th horizontal line further comprising:

a second capacitor coupled between the first terminal of the first capacitor and the first power source;

a fifth transistor for diode-connecting the fourth transistor when the one of the scan signals is supplied to the one of the scan lines of the i-th horizontal line; and a sixth transistor coupled between the fourth transistor and the organic light emitting diode, and configured to turn off in response to the one of the emission control signals supplied to the one of the emission control lines of the i-th horizontal line.

11. The organic light emitting display device of claim 6, wherein the scan driver is configured to supply the one of the emission control signals to the one of the emission control lines of the i-th horizontal line concurrently with the one of the scan signals supplied to the one of the scan lines of the (i−1)-th horizontal line and the one of the scan signals supplied to the one of the scan lines of the i-th horizontal line.

* * * * *